US010524040B2

(12) United States Patent
Hajati et al.

(10) Patent No.: US 10,524,040 B2
(45) Date of Patent: Dec. 31, 2019

(54) HEADPHONES WITH ORIENTATION SENSORS

(71) Applicant: Apple Inc., Cupertino, CA (US)

(72) Inventors: Arman Hajati, San Mateo, CA (US); Supratik Datta, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/194,130

(22) Filed: Nov. 16, 2018

(65) Prior Publication Data

US 2019/0238968 A1 Aug. 1, 2019

Related U.S. Application Data

(60) Provisional application No. 62/623,421, filed on Jan. 29, 2018.

(51) Int. Cl.
*H04R 1/10* (2006.01)

(52) U.S. Cl.
CPC ..... *H04R 1/1041* (2013.01); *H04R 1/1008* (2013.01); *H04R 1/1058* (2013.01)

(58) Field of Classification Search
CPC ... H04R 1/1041; H04R 1/1008; H04R 1/1058
See application file for complete search history.

(56) References Cited

U.S. PATENT DOCUMENTS

| | | | |
|---|---|---|---|
| 7,072,476 | B2 | 7/2006 | White et al. |
| 8,259,984 | B2 | 9/2012 | van der Bilt |
| 9,706,304 | B1 | 7/2017 | Edwards et al. |
| 10,165,348 | B2 | 12/2018 | Kirsch |
| 2013/0121494 | A1 | 5/2013 | Johnston |
| 2013/0279724 | A1 | 10/2013 | Stafford et al. |
| 2017/0094411 | A1 | 3/2017 | Peterson et al. |
| 2017/0339484 | A1 | 11/2017 | Revyn |
| 2018/0288515 | A1 | 10/2018 | Peterson et al. |

FOREIGN PATENT DOCUMENTS

EP 3035698 A1 6/2016

*Primary Examiner* — Regina N Holder
(74) *Attorney, Agent, or Firm* — Treyz Law Group, P.C.; G. Victor Treyz; Kendall W. Abbasi

(57) ABSTRACT

An electronic device such as a pair of headphones may be provided with ear cups having speakers for playing audio to a user. Capacitive sensor electrodes may be used in capturing capacitive sensor ear images that are processed by a machine learning classifier to determine whether the headphones are being worn in a reversed or unreversed orientation. The capacitive sensor electrodes may include grill electrodes that overlap at least part of a speaker grill, cushion electrodes that make capacitive sensor measurements through ring-shaped ear cup cushions that surround the speaker grills, and ring electrodes. The ring electrodes may be formed from metal traces on a flexible printed circuit. The flexible printed circuit may include a portion that wraps around each speaker grill and that is surrounded by a corresponding one of the cushions.

20 Claims, 10 Drawing Sheets

HEADPHONES WITH ORIENTATION SENSORS

This application claims priority to U.S. provisional patent application No. 62/623,421 filed Jan. 29, 2018, which is hereby incorporated by reference herein in its entirety.

FIELD

This relates generally to electronic devices, and, more particularly, to electronic devices such as headphones.

BACKGROUND

Electronic devices such as headphones may contain audio circuitry and speakers for playing audio content for a user. To ensure satisfactory playback of content through the left and right speakers of a set of headphones, the left and right speakers of many headphones are labeled "left" and "right." If a user accidentally wears the headphones in the incorrect orientation with the left speaker on right ear and right speaker on left ear, stereo audio playback will be reversed from its expected configuration. This can lead to undesirable user experiences such as when a user is listening to a movie soundtrack and action on the right of the screen results in sounds in the user's left ear.

SUMMARY

An electronic device such as a pair of headphones may be provided with ear cups having speakers for playing audio to a user. Control circuitry in the electronic device may be used in determining the orientation of the headphones on the head of a user and in taking suitable action in response to the orientation. The control circuitry may, for example, reverse left and right audio channel assignments in response to determining that the headphones are being worn in a reversed orientation.

During operation, capacitive sensor electrodes may be used by the control circuitry in capturing capacitive sensor ear images that are processed by a machine learning classifier. The machine learning classifier may be used to determine whether the headphones are being worn in a reversed or unreversed orientation.

The capacitive sensor electrodes may include grill electrodes that overlap at least part of a speaker grill. The grill electrodes may be formed on a flexible printed circuit having an opening that overlaps a central portion of the grill in alignment with a speaker.

The capacitive sensor electrodes may also include cushion electrodes that make capacitive sensor measurements through ring-shaped ear cup cushions that surround the speaker grills.

Additional ear image data may be captured using ring electrodes. The ring electrodes may be formed from metal traces on a flexible printed circuit such as a flexible printed circuit that also contains grill electrodes or other electrodes. A flexible printed circuit in each ear cup may include a portion that wraps around the speaker grill and that is surrounded by the cushion of that ear cup.

DETAILED DESCRIPTION

An electronic device may be provided with sensors that monitor how the device is oriented relative to the body of a user. The sensors may, for example, include capacitive sensors and other sensors that monitor how a user is wearing a pair of headphones on the user's head (e.g., which ear cup of the headphones is on the user's left ear and which ear cup of the headphones is on the user's right ear). Based on knowledge of the orientation of the headphones on the user's head or other orientation information, the headphones or other electronic device can be configured appropriately. For example, left and right audio channel assignments may be placed in a normal (unreversed) or reversed configuration, and other device settings may be changed.

The electronic device may be any electronic equipment that includes a capacitive sensor. For example, the electronic device may be a pair of headphones, ear buds, wearable equipment such as an item in which circuitry has been incorporated into a piece of clothing or other wearable item (e.g., a hat, goggles, helmet, glasses, etc.), a portable device such as a cellular telephone, or other electronic device. Illustrative configurations in which the electronic device is a pair of headphones may sometimes be described herein as an example.

Figure 1:
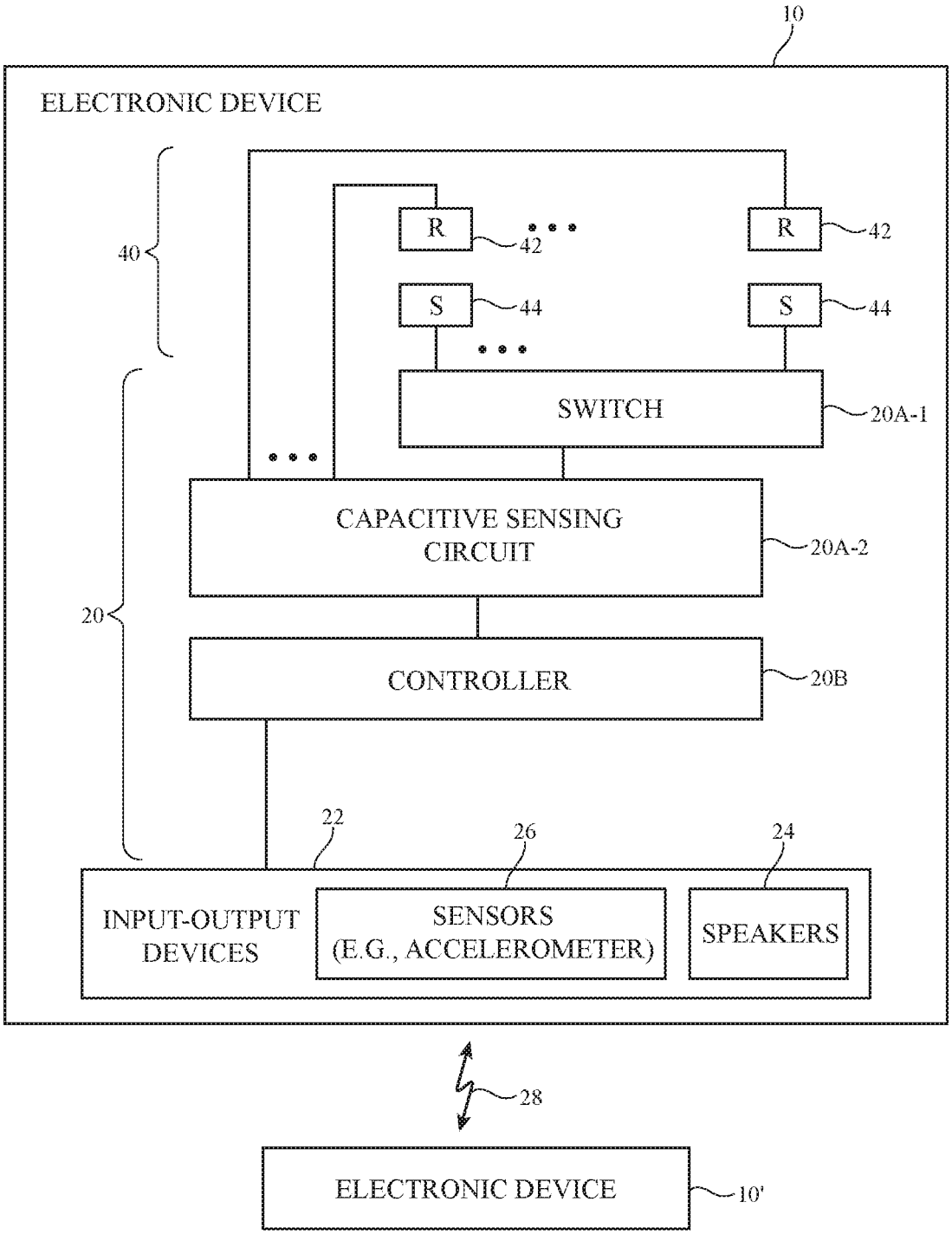
FIG. 1 is a schematic diagram of an illustrative electronic device in accordance with an embodiment.

FIG. 1 is a schematic diagram of an illustrative electronic device. As shown in FIG. 1, electronic device 10 may communicate wirelessly with external equipment such as electronic device 10' using wireless link 28. Wireless signals for link 28 may be light-based signals, may be acoustic signals, and/or may be radio-frequency signals (e.g., wireless local area network signals, Bluetooth® signals, radio-frequency signals in cellular telephone band, signals at 60 GHz, near field communications signals, etc.). Equipment 10 and equipment 10' may have antennas and wireless transceiver circuitry for supporting wireless communications over link 28 (e.g., input-output circuitry in device 10 such as devices 22 may include antennas, wireless transceiver circuitry, and/or other communications circuitry for supporting wireless communications over link 28). Equipment 10' may have the same capabilities as equipment 10

(i.e., devices 10 and 10' may be peer devices) or equipment 10' may include fewer resources or more resources than device 10.

Illustrative device 10 of FIG. 1 has control circuitry 20. Control circuitry 20 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 20 may be used to control the operation of device 10 (see, e.g., controller 20B). The processing circuitry may be based on one or more microprocessors, microcontrollers, digital signal processors, capacitance-to-digital converter chips, baseband processors, power management units, audio chips (e.g., chips with audio amplifiers that can be selectively assigned to play right channel audio in a first ear speaker of device 10 and left channel audio in a second ear speaker or vice versa), application specific integrated circuits, etc.

Device 10 may include a sensor for detecting a user's body parts such as portions of a user's ears. The sensor may be formed from capacitive sensing circuitry with self-capacitance and/or mutual capacitance electrodes (e.g., capacitive sensor electrodes that form capacitive sensor pixels). This allows the capacitive sensor circuitry to capture capacitive sensor images of a user's ears. A machine learning classifier may then be used to identify the user's left and right ears and thereby identify the orientation of electronic device 10 on the head of the user. If desired, the sensor that is used in gathering sensor data from the user's ears may include optical proximity sensor elements (e.g., light sources such as infrared light-emitting diodes and corresponding infrared light detectors), inductive proximity sensor elements (e.g., induction loops and corresponding current sensing circuits for detecting changes in current due to the changing presence of metals or other materials in the vicinity of the loops), force-based sensors, acoustic sensors, or other sensor circuits that can be configured to gather sensor data (e.g., sensor image data) on the user's ears. Illustrative configurations in which electronic device 10 has capacitive sensor circuitry for gathering capacitive sensor image data on the user's ears (capacitive sensor ear images) may sometimes be described herein as an example.

As shown in the illustrative configuration of FIG. 1, device 10 may include a capacitive sensor having electrodes 40. Control circuitry 20 may include circuitry for using electrodes 40 in making capacitive sensor measurements. For example, control circuitry may include capacitive sensor circuitry that is coupled to electrodes 40 such as capacitive sensing circuitry 20A-2 and switching circuitry such as switch 20A-1. Capacitive sensor electrodes 40 may include reference electrodes 42 and sense electrodes 44 and/or other electrode structures. If desired, a driven shield configuration may be used for electrodes 40. Switch 20A-1 may be dynamically configured based on control signals from controller 20B so that capacitive sensor measurements can be gathered from a desired pair of electrodes (e.g., a selected electrode 44 and corresponding electrode 42) and/or from sets of multiple combined electrodes (e.g., two or more electrodes 44 and two or more respective electrodes 42 that have been combined to enhance detection range).

Electrodes 40 may be arranged on one or more substrates to form a two-dimensional capacitive electrode pixel array. This allows capacitive sensor image data to be gathered. The resolution of the capacitive images captured in this way depends on the density of electrodes 40 that are used. For high spatial resolution, numerous electrodes 40 may be include in the capacitive sensor. For ease of processing at lower spatial resolutions, fewer electrodes 40 may be used. In general, any suitable number of electrodes 40 may be included in device 10 (e.g., 10-1000, at least 50, at least 100, at least 200, at least 400, fewer than 300, fewer than 250, etc.). Capacitive sensor electrodes 40 may be formed on one or more substrates such as one or more flexible printed circuits and may be mounted at one or more locations within device 10 (e.g., to gather capacitive sensor images of a user's ear and surrounding body from multiple different locations).

Input-output circuitry in device 10 such as input-output devices 22 may be used to allow data to be supplied to device 10 and to allow data to be provided from device 10 to external devices. Input-output devices 22 may include buttons, joysticks, scrolling wheels, touch pads, key pads, keyboards, tone generators, vibrators, cameras, sensors 26 (e.g., ambient light sensors, magnetic sensors, force sensors, touch sensors, accelerometers, and other sensors), light-emitting diodes and other status indicators, data ports, displays, etc. Input-output devices 22 may include audio components such as microphones and speakers 24. Speakers 24 may be mounted in left and right ear cups in over-the-ear or on-the-ear headphones. The headphones may have a supporting member that couples the ear cups together and/or may be coupled using supporting members in a head mounted display (e.g., band or other support structures in a helmet, goggles, or glasses with ear cups), and/or may have other headphone configurations.

A user can control the operation of device 10 by supplying commands through input-output devices 22 and may receive status information and other output from device 10 using the output resources of input-output devices 22.

Control circuitry 20 may be used to run software on device 10 such as operating system code and applications. During operation of device 10, the software running on control circuitry 20 may use the capacitive proximity sensor formed from electrodes 40 (e.g., a capacitive proximity sensor(s) in one or both ear cups) to gather information on how device 10 is oriented (e.g., which ear cup is located on the user's right ear and which ear cup is located on the user's left ear) and other information about the usage of device 10. This software may also gather and use other information such as accelerometer signals from sensors 26 (e.g., signals indicating that device 10 is in use by a user or is not in use) and may gather and use other information from input-output devices 22 in device 10 (e.g., button input, voice input, and/or other input from a user). A user may, for example, supply input to buttons, touch sensors, accelerometers that detect finger taps, or other devices 22 using one or more fingers and/or other external objects (e.g., a stylus, etc.).

The left ear cup, right ear cup, or both the left and right ear cups may be provided with electrodes 40. The capacitive sensor formed from electrodes 40 may capture capacitive sensor image data from electrodes 40 on one or both ear cups. With this information, device 10 can determine whether the headphones are being worn in an unreversed or in a reversed configuration and can make audio adjustments accordingly (e.g., by adjusting left/right channel assignments using control circuitry 20 such as controller 20B).

Electronic device 10 (and external equipment 10') may, in general, be any suitable electronic equipment. Electronic device 10 (and device 10') may, for example, be a computing device such as a laptop computer, a computer monitor containing an embedded computer, a tablet computer, a cellular telephone, a media player, or other handheld or portable electronic device, a smaller device such as a wrist-watch device (e.g., a watch with a wrist strap), a pendant device, a headphone or earpiece device, a device embedded in eyeglasses or other equipment worn on a user's head (e.g., a pair of headphones, ear buds, wearable equipment such as an item in which circuitry has been incorporated into a piece of clothing or other wearable item such as a hat, goggles, helmet, glasses, etc.), a portable device such as a cellular telephone, a television, a computer display that does not contain an embedded computer, a gaming device, a navigation device, an embedded system such as a system in which electronic equipment with a display is mounted in a kiosk or automobile, furniture, fabric-based items such as pillows and clothing, equipment that implements the functionality of two or more of these devices, or other electronic equipment.

Figure 2:
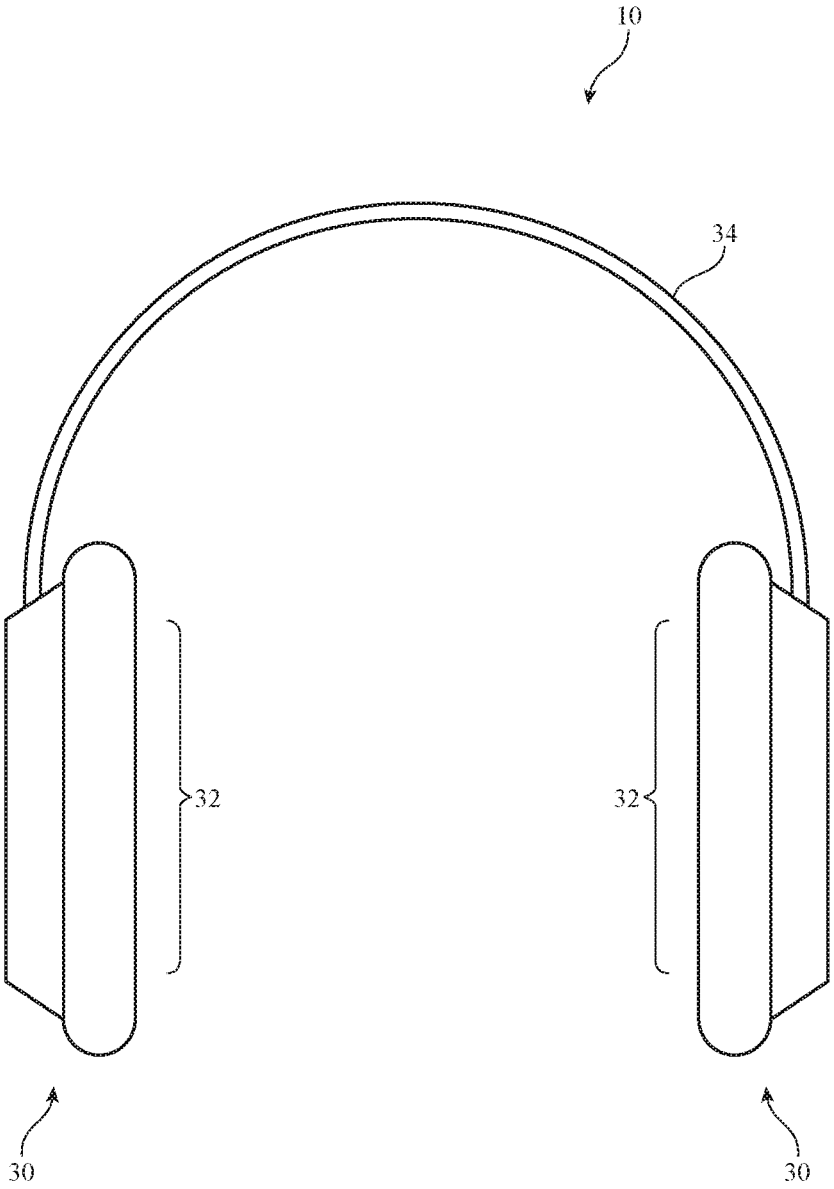
FIG. 2 is a front view of an illustrative electronic device such as a pair of headphones in accordance with an embodiment.

FIG. 2 is a front view of an illustrative electronic device. In the illustrative configuration of FIG. 2, device 10 is a portable device such as a pair of headphones (earphones). Other configurations may be used for device 10 if desired. The example of FIG. 2 is merely illustrative.

As shown in FIG. 2, device 10 may have ear cups such as ear cups 30. There may be two ear cups 30 in device 10 that are coupled by a supporting member such as band 34 or other support structure (straps, helmet or goggle structures, parts of glasses, etc.). Band 34 may be flexible and may have a curved shape to accommodate a user's head. There may be left and right ear cups 30 in device 10, one for one of the user's ears and the other for the other of the user's ears. Each ear cup may have an area such as area 32 (sometimes referred to as a grill area) through which sound may be emitted from a speaker (e.g., a speaker system with one or more drivers). One or more locations in the ear cups may be provided with electrodes 40 so that capacitive proximity sensor measurements may be made of the user's ear to determine device orientation. Control circuitry 20 may be coupled to electrodes 40 in one or both of the ear cups and may be used in detecting ear patterns of a user's left and/or right ears.

When worn in an unreversed configuration, the right ear cup of device 10 will supply audio to the right ear of the user and the left ear cup of device 10 will supply audio to the left ear of the user. In a reversed configuration, the right ear cup is adjacent to the user's left ear and the left ear cup is adjacent to the user's right ear. For correct audio playback, the assignment of the left and right channels of audio that are being played back to the user can be reversed by control circuitry 20 (so that the left channel of audio is played through the right ear cup and vice versa) whenever device 10 is being worn in the reversed configuration. Unreversed right-left channel assignments may be used when device 10 is being worn in the unreversed configuration.

Device 10 may have an asymmetrical design or may have a symmetrical design. A symmetrical design may be used to provide device 10 with a desired symmetrical appearance. In some configurations for device 10 (e.g., when device 10 has a symmetrical design), there may be few or no recognizable differences between unreversed and reversed orientations for device 10. In this type of scenario, it may be desirable to use capacitive proximity sensor input or input from other sensors 26 to determine whether to operate device 10 in an unreversed audio playback or reversed audio playback configuration. Capacitive sensor electrodes 40 on inwardly facing (ear-facing) portions of ear cups 30 may be used to measure the shapes of the user's ears and thereby determine the orientation of device 10 on the user's head.

Figure 3:
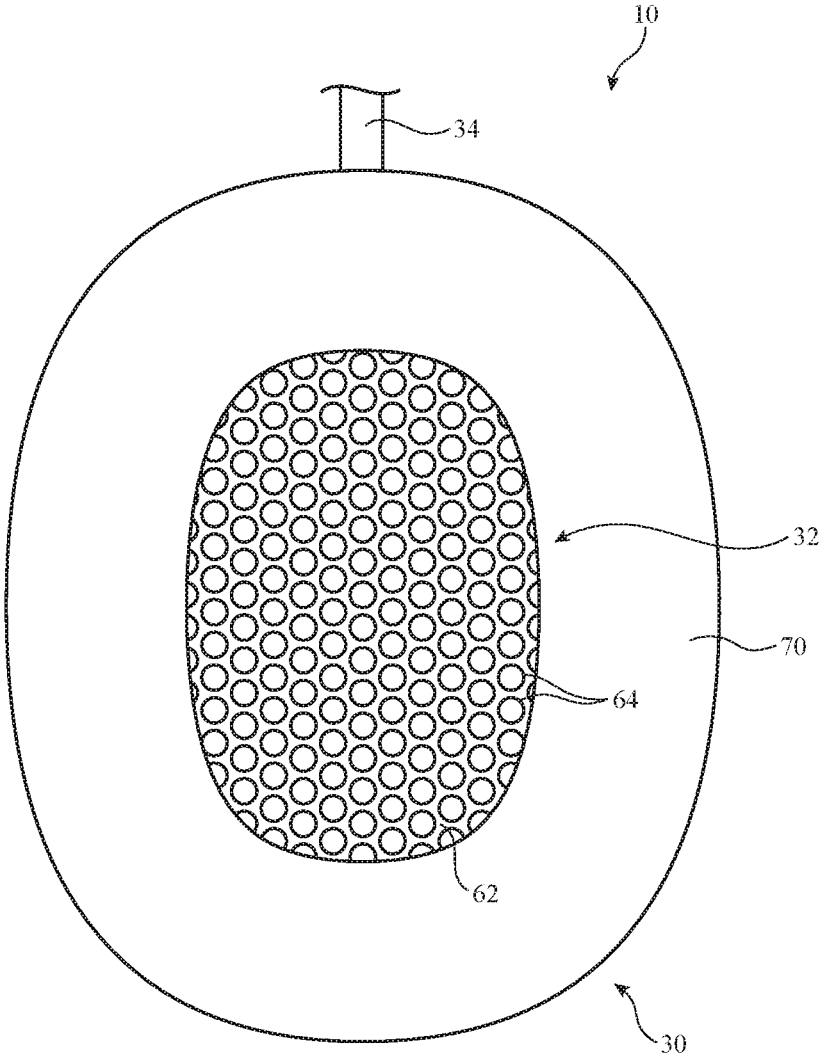
FIG. 3 is a side view of an illustrative ear cup for an electronic device such as a pair of headphones in accordance with an embodiment.

FIG. 3 shows the inwardly facing side of an illustrative ear cup. As shown in FIG. 3, ear cup 30 may have a ring-shaped cushion 70 that is configured to rest against a user's head while surrounding a user's ear. In area 32, sound may be emitted towards a user's ear through openings 64 in speaker grill 62. Speaker grill 62 and other portions of the housing of device 10 (e.g., cushions 70, band 34, etc.) may be formed from polymer (plastic), metal, glass, ceramic, fiber-composite materials, wood, fabric, cotton or other natural materials, other materials, and/or combinations of two or more of these materials. Conductive structures (e.g., sheet metal) have the potential to block capacitive sensor operation, so dielectric materials such as polymer, polymer-containing fabrics, and/or other dielectric may be used in locations that overlap sensor electrodes 40.

Figure 4:
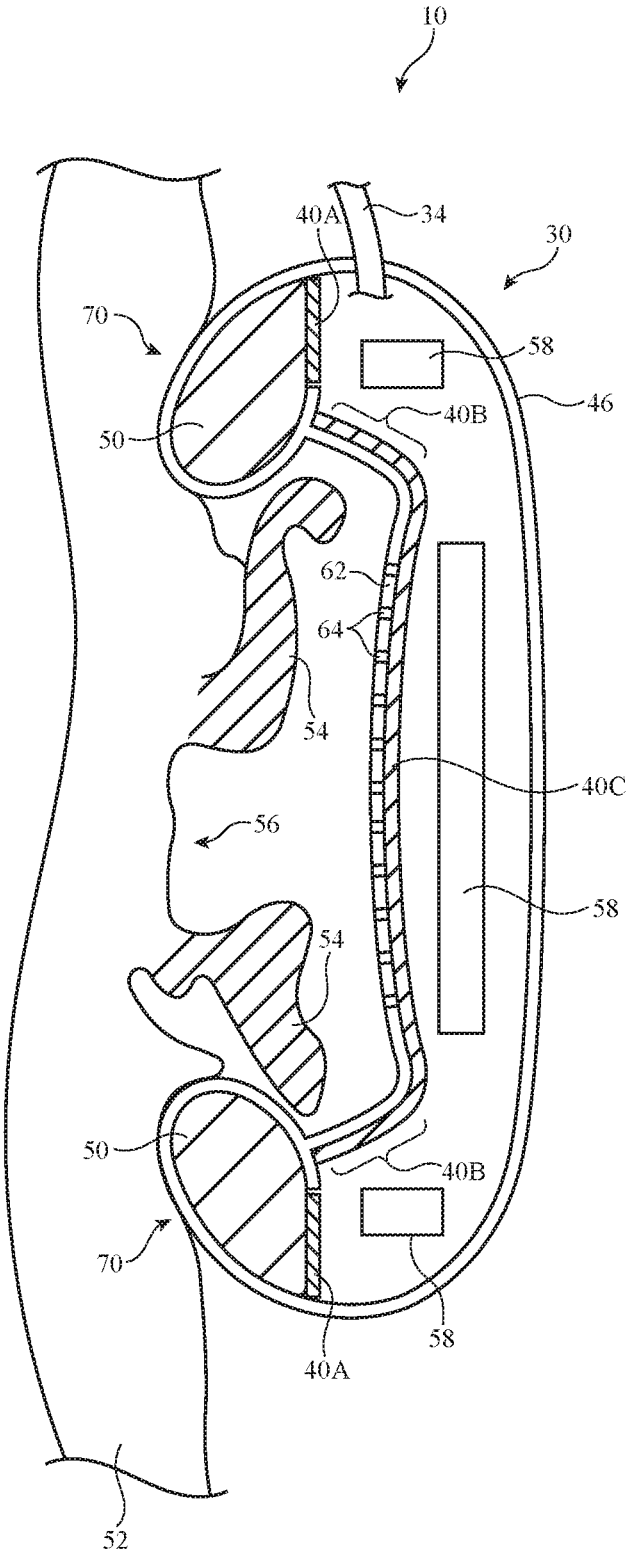
FIG. 4 is a cross-sectional side view of an illustrative ear cup for a pair of headphones in accordance with an embodiment.

A cross-sectional side view of an illustrative ear cup when pressed against a user's head while device 10 is being worn on the user's head is shown in FIG. 4. As shown in FIG. 4, device 10 includes ear cup 30. Ear cup 30 may have housing structures such as outer housing 46. Ear cup cushion 70 may have a ring shape and may be formed from soft materials (e.g., an outer fabric or polymer layer such a layer 48 surrounding a foam ring or other compressible ring-shaped inner cushion member such as member 50). Speaker 58 may be mounted within a cavity in the interior of ear cup 30 between outwardly facing housing structures such as outer housing 46 and speaker grill 62. In this position, speaker 58 may provide sound through speaker grill openings 64 that is received by ear canal 56 of the user's ear 54. If desired, other circuit components 58 (see, e.g., circuitry 20, input-output devices 22, etc. of FIG. 1) may be mounted within the interior of ear cup 30. Circuitry for device 10 may also be mounted within band 34.

Electrodes 40 for the capacitive sensor of device 10 may be mounted in ear cup locations that are adjacent to ear 54 when cushion 70 of ear cup 30 is resting against the side of the user's head (head 52). In this position, electrodes 40 can gather capacitance sensor ear image data (pixel patterns) that allow control circuitry 20 to identify the user's left and right ears and thereby determine the orientation of device 10 on the user's head 52. As shown in the illustrative configuration of FIG. 4, electrodes 40 can be mounted in multiple different locations such as (1) the outwardly facing interior surface of cushion 70 (see, e.g., electrodes 40A), the outwardly facing interior surface of speaker grill 62 (see, e.g., electrodes 40C), and a circumferential ring-shaped surface of the housing of ear cup 30 that extends between the interior surface of grill 62 and the interior surface of cushion 70 (see, e.g., electrodes 40B).

Electrodes 40A may gather capacitance measurements through cushion 70 and may therefore sometimes be referred to as cushion electrodes. Cushion electrodes 40A may be used in detecting when ear cup 30 is resting against head 52 (e.g., when device 10 is being worn by the user).

Electrodes 40C may gather capacitance measurements through speaker grill 62 and may therefore sometimes be referred to as speaker grill electrodes. Electrodes 40C are directed towards ear 54 and may therefore be used in capturing an image of ear 54 (e.g., to determine the shape and location of ear parts such as the helix, the leg of the helix, the ear hole (for ear canal 56), the tragus, the conch, the anti-tragus, and the lobe). Electrodes 40A and 40C may lie in parallel planes. The central portion of electrodes 40C (e.g., a portion overlapping the center of grill 62) may be omitted and the substrate on which these electrodes are formed may have an opening aligned with speaker 58.

Electrodes 40B may be angled (e.g., at 10-80° or other non-zero angle) with respect to the surface normal of the planes in which electrodes 40A and 40C lie. Electrodes 40B form a ring-shaped strip (ring) around the periphery of ear 54 and may therefore sometimes be referred to as ring electrodes. Ring electrodes 40B are directed towards peripheral portions of ear 54 and may therefore be used in determining the shape of ear 54 and identifying ear shape. Ring electrodes 40B may surround grill electrodes 40C and may be surrounded by cushion electrodes 40A.

Figure 5:
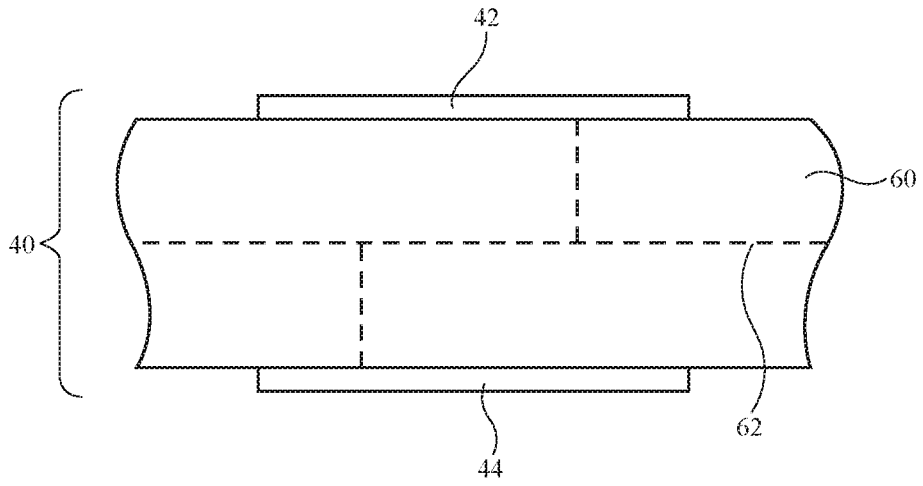
FIG. 5 is a cross-sectional side view of an illustrative flexible printed circuit with metal traces forming capacitive sensor electrodes in accordance with an embodiment.
Figure 6:
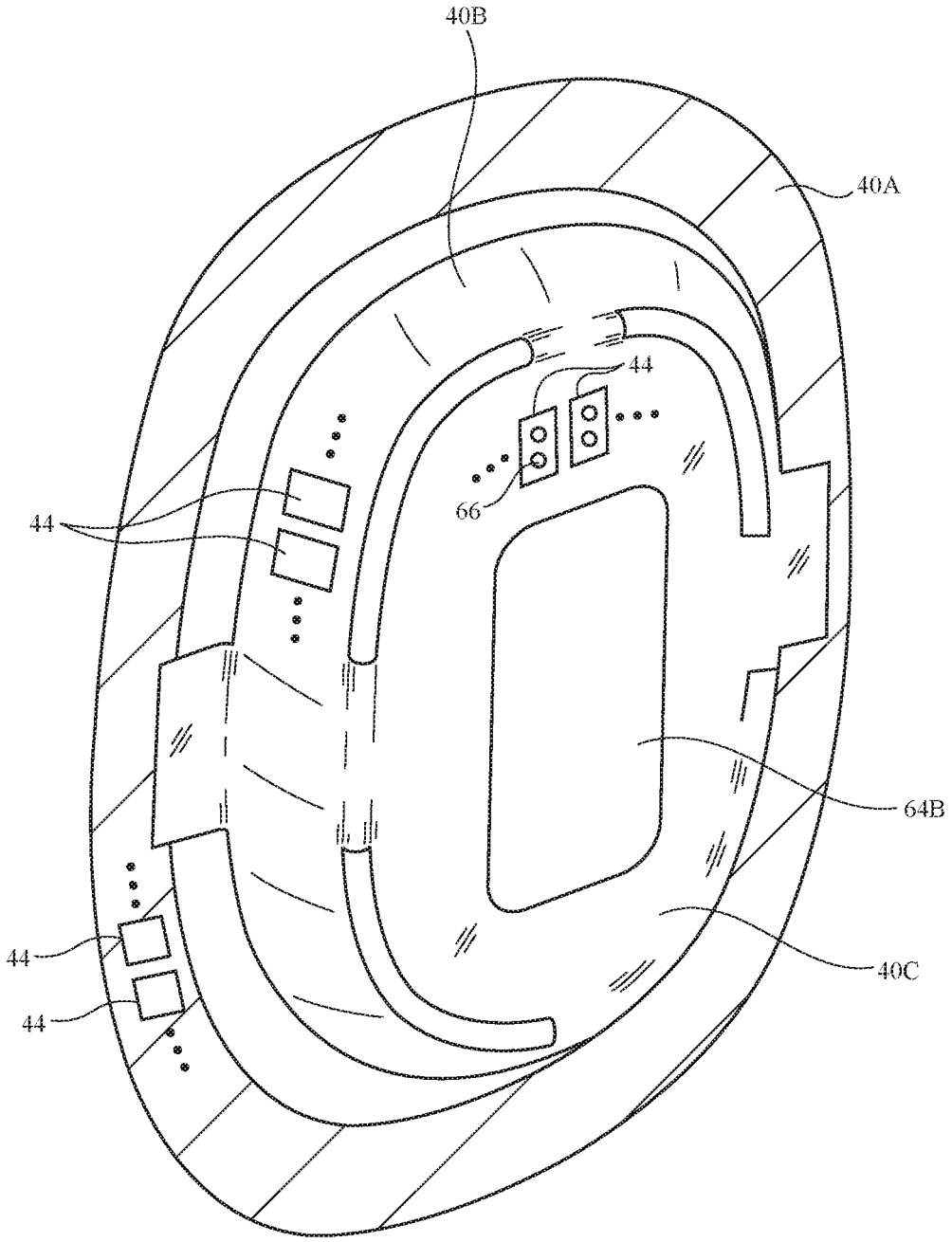
FIG. 6 is a rear perspective view of an interior portion of an ear cup with flexible printed circuit sensor electrodes in accordance with an embodiment.

If desired, electrodes 40 may include additional sets of electrodes in each ear cup or fewer sets of electrodes in each ear cup. The example of FIG. 4 is merely illustrative. FIG. 5 is a cross-sectional side view of an illustrative flexible circuit with illustrative electrodes 40. As shown in FIG. 5, electrodes 40 may be mounted on a flexible printed circuit substrate such as substrate 60 (e.g. a flexible layer of polyimide or a sheet of other polymer) and may include one or more layers, internal and/or external traces such as illustrative interconnects 62, capacitive sensor electrodes on an upper surface of substrate 60 such as electrodes 42 and overlapping capacitive sensor electrodes on an opposing lower surface of substrate 60 such as electrodes 44, FIG. 6 is a rear view of an interior portion of an illustrative ear cup 30 showing how sensor circuitry for device 10 may be formed from one or more flexible printed circuits (see, e.g., the flexible printed circuit of FIG. 5). A first flexible printed circuit may have a substrate with metal traces patterned to form cushion electrodes 40A. The first flexible printed circuit may have a planar ring shape with metal traces that form electrodes 44 overlapping corresponding electrodes 42 as shown in FIG. 5. A second flexible printed circuit may form ring electrodes 40B and speaker grill electrodes 40C. The portion of the second flexible printed circuit that forms ring electrodes 40B may have metal traces forming electrodes 44 that overlap corresponding electrodes 42. This portion of the second flexible printed circuit may have a ring shape formed from flexible printed circuit substrate material that is angled at a non-zero angle with respect to electrodes 40A and 40C (as an example). Another portion of the second flexible printed circuit or a different flexible printed circuit substrate may form speaker grill electrodes 40C. This portion of the second flexible printed circuit may have a planar shape and may contain an array of metal electrodes 44 (and overlapped electrodes 42) with openings 66 that mate with corresponding speaker grill openings 64 (FIG. 4) to allow sound from speaker 58 to pass through the speaker grill. A central portion of the second flexible printed (e.g., central portion 64B of FIG. 6) may contain electrodes 40 or may have an opening to enhance sound propagation.

Figure 7:
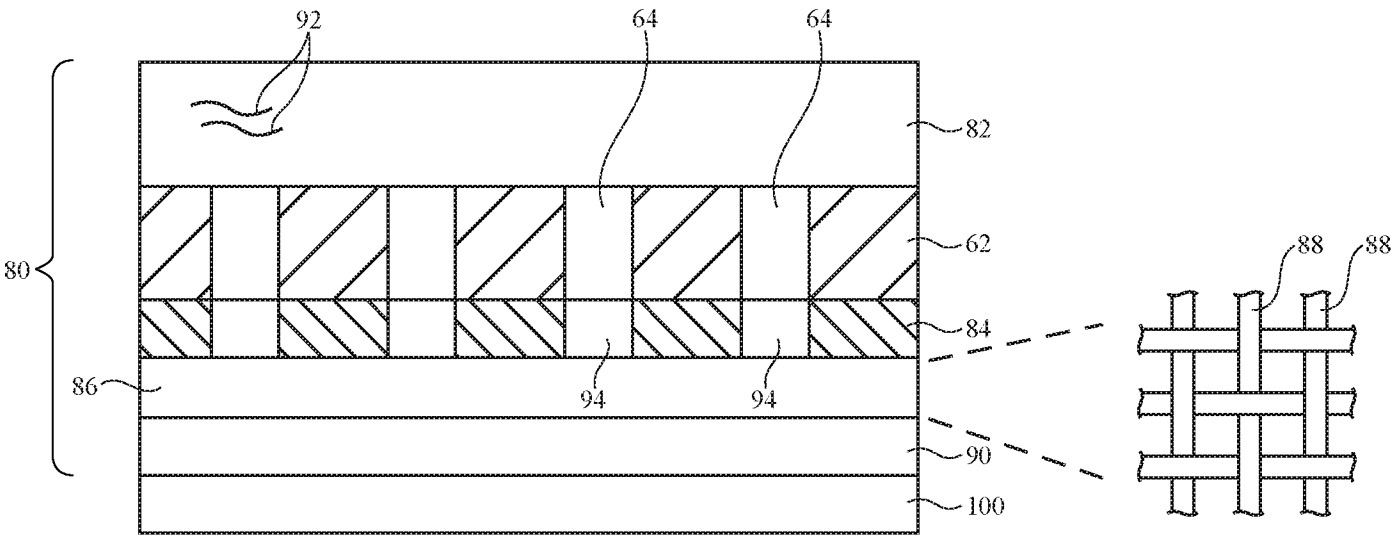
FIG. 7 is a cross-sectional side view of an illustrative covering layer for an electronic device housing in accordance with an embodiment.

FIG. 7 is a cross sectional side view of an illustrative fabric layer and other structures that may be used in forming ear cup 30. In the example of FIG. 7, layers 80 include portions of speaker grill 62. If desired, fabric and other layers of material may be used in covering housing 46, cushions 70, and/or other structures in device 10 (e.g., other structures with electrodes, speaker grill 62, etc.).

As shown in FIG. 7, layers 80 may include fabric layer 82. Fabric layer 82 may serve as a covering layer and may have intertwined strands of material 92. Strands 92 may be woven, knit, braided, or otherwise intertwined to form fabric 82. Fabric 82 may be sufficiently porous to allow sound to pass through fabric 82 and/or openings may be formed in fabric 82 in alignment with speaker grill openings and other sound openings.

Speaker grill 62 may have openings 64. Pressure sensitive adhesive layer 84 may be used to attach speaker grill 62 to acoustic mesh layer 86. Layer 84 may have openings 94. Openings 94 may have any suitable shape. As an example, one or more of openings 94 may overlap one or more corresponding openings 64 in speaker grill 62. Acoustic mesh 86 may be formed from intertwined strands of material 88 such as woven strands, etc. Mesh 86 may have smaller openings (pores) than grill 62 and may therefore help prevent dust and other contaminants from entering into the interior of device 10. Pressure sensitive adhesive 90 may be used to help mount internal structures 100 against mesh 86. Internal structures 100 may include electrodes 40, speaker 58, and/or other internal components.

Figure 8:
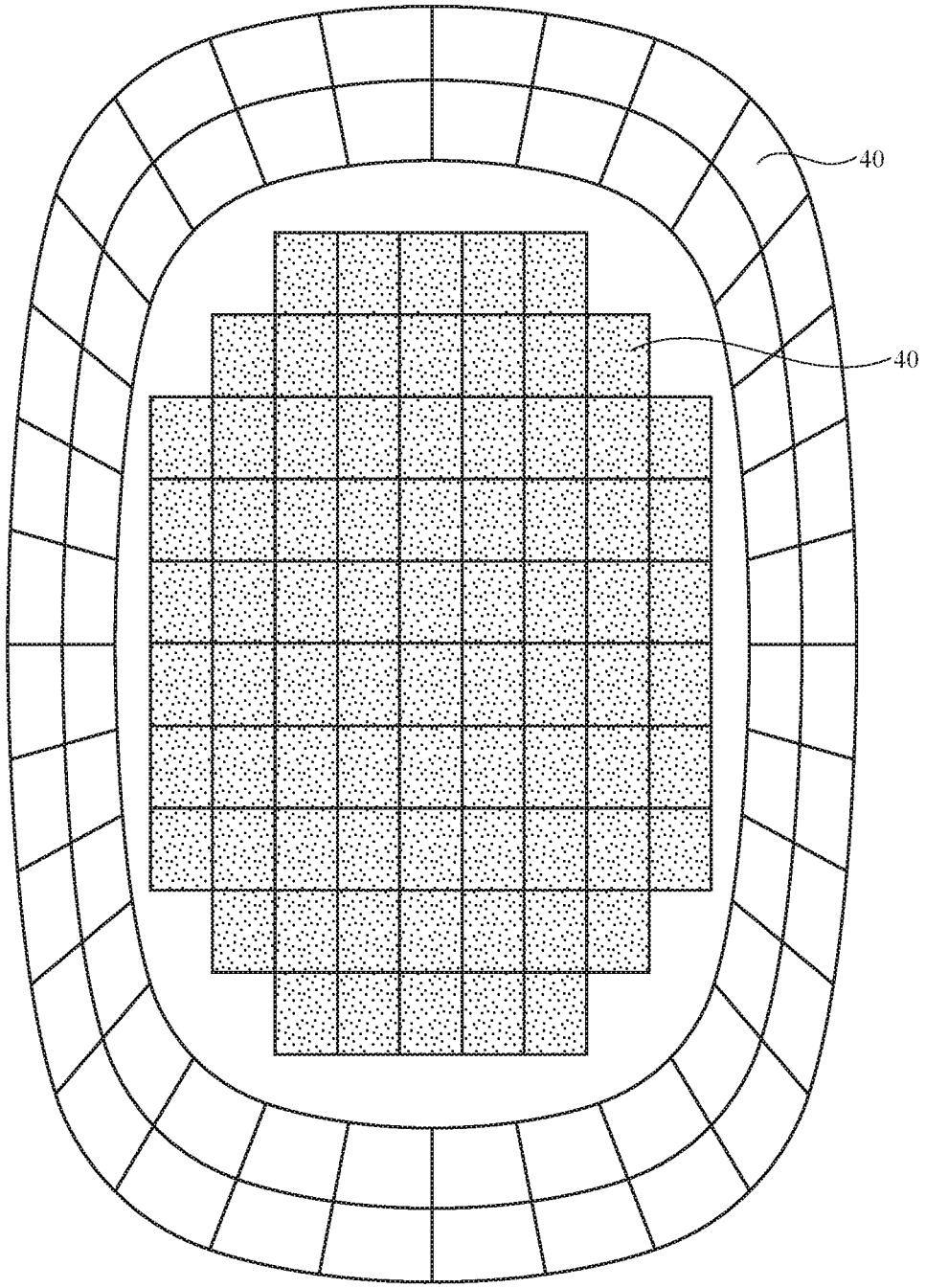
FIGS. 8 and 9 are front views of illustrative capacitive sensor electrode arrays having respective Cartesian and polar electrodes in accordance with embodiments.
Figure 9:
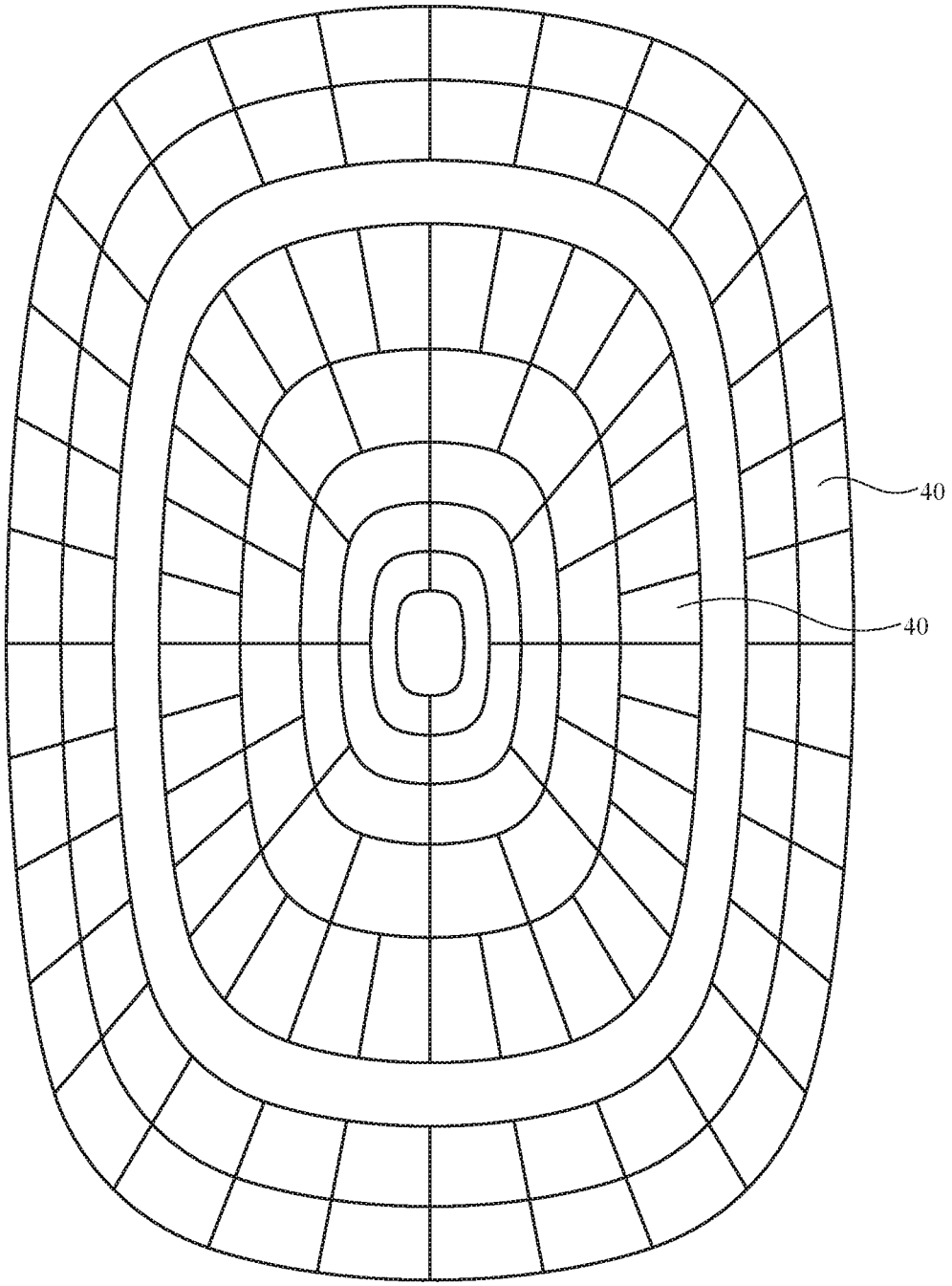

Illustrative electrode patterns for electrodes 40 are shown in FIGS. 8 and 9. In the examples of FIGS. 8 and 9, electrodes 40 include a central set of electrodes (e.g., for forming speaker grill electrodes 40C) and an outer set of surrounding electrodes (e.g., for forming ring electrodes 40B and/or cushion electrodes 40A. If desired, some of the centermost electrodes 40 may be omitted to accommodate an opening such as opening 64B of FIG. 6 (e.g., to form a passageway for sound from speaker 58). Electrodes 40 may have outer electrodes with edges that are aligned with lines emanating radially from a central point (sometimes referred to as radially patterned electrodes, radial-edge electrodes, or polar electrodes). The central electrodes of electrodes 40 may have rectilinearly patterned electrodes having edges aligned with Cartesian axes (perpendicular vertical and horizontal axes) as shown in FIG. 8 or may have additional radially patterned electrodes as shown in FIG. 9 (e.g., the grill, ring, and/or cushion electrodes may have a polar layout). Other patterns may be used for electrodes 40 if desired.

Figure 10:
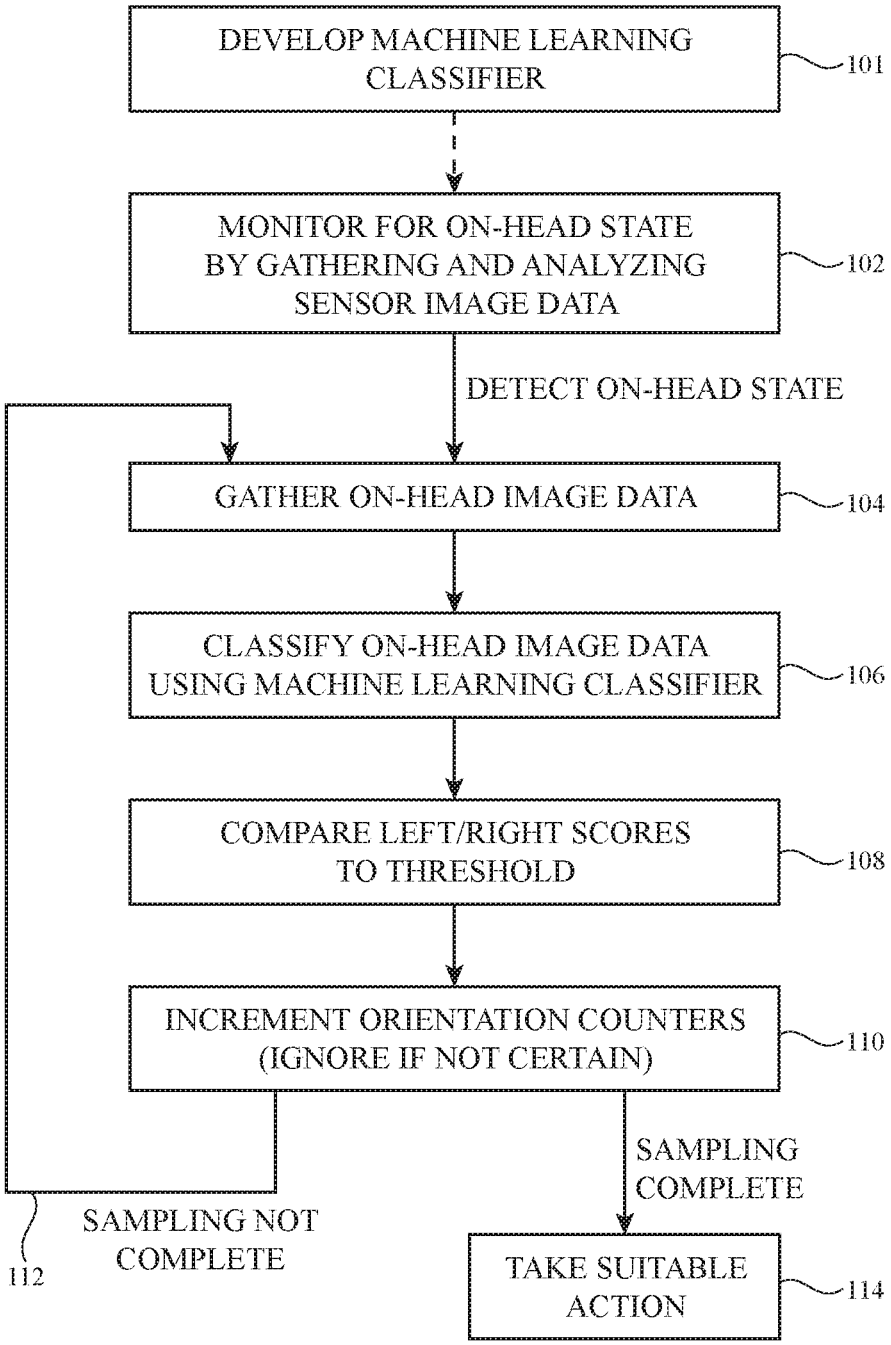
FIG. 10 is a flow chart of illustrative operations involved in using an electronic device with capacitive sensor electrodes in accordance with an embodiment.

FIG. 10 is a flow chart of illustrative operations involved in using sensor circuitry in device 10 to identify the orientation of device 10 on the head of a user.

During the operations of block 101, a machine learning classifier may be developed. The machine learning classifier may be trained by placing device 10 (or a representative version of device 10) on the ears of one or more users (or the ears of phantom users). Modeling operations may also be performed. Using modeling results and/or user studies involving measurements on representative ears, the machining learning classifier can be trained. The machine learning classifier can then be stored in device 10 for subsequent use in the field.

During the operations of block 101, while device 10 is being used by a user, device 10 (e.g., control circuitry 20 such as microprocessor circuitry, circuitry in a capacitance to digital converter, etc.), can use capacitive sensing circuitry (e.g., electrodes 40) to gather capacitive sensor data (e.g., capacitive sensor images from the capacitive sensor pixels formed from electrodes 40) to monitor for the presence of an on-head state for device 10. Capacitive sensor measurements may be made with a capacitive sensor that includes electrodes 40. Capacitive sensors for device 10 may be sensitive to contact by external objects and may detect external objects in the vicinity of the capacitive sensors. Accordingly, capacitive sensors for device 10 may sometimes be referred to as touch sensors and/or proximity sensors.

In general, any suitable sensor information may be used in determining when device 10 is present on the head of the user (e.g., accelerometer data indicating device movement, capacitive sensor data, information from a force sensor such as a strain gauge that detects when band 34 has been stretched, output from a pressure activated switch that detects the presence of a user's ear against device 10, etc.). With one illustrative approach, capacitive sensor data may be evaluated to determine when device 10 is present on the user's head.

During operation, capacitive sensor readings may be compared to baseline capacitive sensor data (e.g., data taken at a relatively low frame rate of about 1-10 Hz that has been filtered using low-pass filtering to produce a historical average). The comparison of current capacitive sensor data to baseline capacitive sensor data may help avoid false detection events due to temperature drift and other noise sources. In some arrangements, accelerometer data and/or capacitive sensor data may be compared to thresholds to determine whether device 10 is on a user's head. For example, control circuitry in device 10 can conclude that device 10 is on a user's head during the operations of block 102 if capacitive sensor readings deviate from baseline capacitive sensor data by more than a threshold amount and/or if accelerometer data has a value that exceeds a predetermined accelerometer threshold value.

In response to determining during the on-head state monitoring operations of block 102 that device 10 is on the head of a user, device 10 can gather and process additional data to determine the orientation of device 10 on the user's head.

During the operations of block 104, capacitive sensor data may be acquired. For example, 10-20 capacitive sensor image frames may be captured and noisy frames discarded. The machine learning classifier developed during the operations of block 101 may then be applied to the capacitive sensor data (capacitive sensor images). The output of the machine learning classifier may include numerical values (e.g., correlation coefficient values between −1 for 0% correlation and +1 for 100% correlation) representing the likelihood of left and right ears being present on the respective ear cups. As an example, if device 10 is oriented so that a first ear cup is present on the user's left ear and a second opposing ear cup is present on the user's right ear, the machine learning classifier may generate values of left ear correlation coefficient L=0.9 and right ear correlation coefficient R=−0.85 for the first ear cup and correlation coefficient values of L=−0.92 and R=0.91 for the second ear cup. These values may then be compared to a threshold value (e.g., 0, 0.1, or other suitable correlation coefficient threshold) and a determination of the likely orientation of device 10 on the ears of the user can be made accordingly.

Orientation counters can be updated based on the results of the threshold comparisons of block 108. For example, control circuitry 20 can, during the operations of block 110, maintain a first orientation counter (e.g., an unreversed orientation counter) and a second orientation counter (e.g., a reversed orientation counter) and can increment these counters based on the comparisons of block 108. The first counter may be incremented whenever the detected orientation is such that the first cup is on the left ear and the second counter may be incremented in response to determining that the orientation is such that the first cup is on the right ear. In scenarios in which the orientation of device 10 is not clear, neither counter may be incremented. As indicated by line 112, the operations of blocks 104, 106, 108, and 110 can be repeated (e.g., multiple capacitive sensor images can be collected). After sampling is complete, the orientation of device 10 on the user's head may be determined from the counter with the greatest count (e.g., the orientation of device 10 may be assigned an unreversed or reversed state). If no orientation is clearly determined from the capacitive sensor measurements, control circuitry 20 can play audio instructions for the user (e.g., "tap your right ear cup to continue") and can monitor accelerometers or other sensors in the ear cups for corresponding vibrations from a user's finger tap. The finger tap input can be used to identify which ear cup is on the user's right ear and therefore can be used in identifying the orientation of device 10.

During the operations of block 114, suitable action may be taken by control circuitry 20 based on the determined orientation of device 10 on the user's head. For example, audio channel assignments can be made (e.g., to play left channel audio through the speaker in the ear cup on the user's left ear and to play right channel audio through the speaker in the ear cup on the user's right ear).

During the classification process of FIG. 10, capacitive sensor ear images can be compared to baseline images so that a differential image can be analyzed using the machine learning classifier. The classifier may be a linear support vector machine with optional non-linear functions for each input pixel value or combination of pixel values (e.g., non-linear kernels), a quadratic classifier, single or multilayer perception or neural network classifiers, or other suitable machine learning classifiers. As described in connection with the operations of block 101, the classifier may be trained using a set of training samples (e.g., based on user studies). The classifier algorithm may be implemented using control circuitry 20 (e.g., microprocessor circuitry, microcontroller circuitry, a capacitance-to-digital converter integrated circuit or other capacitance-to-digital converter circuitry, a digital signal processor, system-on-chip circuitry, etc.). Capacitance sensor electrodes that are used in capturing ear image data may also be used for detecting the presence of ears (e.g., to detect the on-head state) and/or other sensors can be used to detect the on-head state.

Table of Reference Numerals

| | | | |
|---|---|---|---|
| 10 | electronic device | 10' | equipment |
| 20 | control circuitry | 20A-1 | switch |
| 20A-2 | capacitive sensing circuitry | 20B | controller |
| 22 | input-output devices | 24 | speaker |
| 26 | sensor | 28 | link |
| 30 | ear cups | 32 | area |
| 34 | band | 40 | electrodes |
| 40A | electrodes | 40B | electrodes |
| 40C | electrodes | 42 | electrodes |
| 44 | electrodes | 46 | housing |
| 50 | member | 52 | head |
| 54 | ear | 56 | ear canal |
| 58 | speaker | 60 | substrate |
| 62 | grill | 64 | openings |
| 64B | openings | 66 | openings |
| 70 | cushions | 80 | layers |
| 82 | fabric | 84 | layer |
| 86 | mesh | 88 | material |
| 90 | adhesive | 92 | strands |
| 94 | openings | 100 | internal structures |

The foregoing is merely illustrative and various modifications can be made to the described embodiments. The foregoing embodiments may be implemented individually or in any combination.

What is claimed is:

1. Headphones configured to be worn in an orientation that is unreversed or reversed, comprising:

first and second ear cups, wherein each of the first and second ear cups includes:

a speaker;

a grill with openings overlapping the speaker; and a cushion surrounding the grill;

capacitive sensor circuitry including cushion electrodes; and control circuitry configured to gather capacitive sensor ear images at least partly through the cushion of at least one of the first and second ear cups using the cushion electrodes.

2. The headphones defined in claim 1 wherein the control circuitry is configured to determine the orientation based on the capacitive sensor ear images gathered with the cushion electrodes.

3. The headphones defined in claim 2 further comprising grill electrodes, wherein the control circuitry is configured to gather the capacitive sensor ear images at least partly through the grill of at least one of the first and second ear cups using the grill electrodes.

4. The headphones defined in claim 3 further comprising a ring of ring electrodes that surrounds the grill and that is surrounded by the cushion electrodes, wherein the control circuitry is configured to gather the capacitive sensor ear images at least partly with the ring electrodes.

5. The headphones defined in claim 4 wherein the control circuitry is configured to determine the orientation by applying a machine learning classifier to the capacitive sensor ear images.

6. The headphones defined in claim 4 wherein at least some of the grill electrodes have a polar layout.

7. The headphones defined in claim 4 wherein the first and second ear cups each have a fabric covering layer.

8. The headphones defined in claim 7 wherein the first and second ear cups each have a mesh layer with openings and wherein the grill of each of the first and second ear cups is interposed between the mesh layer of that ear cup and the fabric covering layer of that ear cup.

9. The headphones defined in claim 4 further comprising a flexible printed circuit having metal traces that form at least the ring electrodes and the grill electrodes.

10. The headphones defined in claim 4 wherein the grill electrodes are arranged in a ring pattern on a printed circuit substrate with a central opening overlapping one of the speakers.

11. Headphones, configured to be worn in an orientation that is unreversed or reversed, comprising:

first and second ear cups, wherein each of the first and second ear cups includes:

a speaker;

a grill with openings overlapping the speaker; and a ring-shaped cushion;

capacitive sensor circuitry including a ring of ring electrodes in each of the first and second ear cups that surrounds the grill and that is surrounded by the ring-shaped cushion; and control circuitry configured to gather capacitive sensor ear images at least partly using the ring electrodes.

12. The headphones defined in claim 11 wherein the control circuitry is configured to determine the orientation based on the capacitive sensor ear images gathered with the ring electrodes.

13. The headphones defined in claim 12 further comprising cushion electrodes in the first and second ear cups, wherein the control circuitry is configured to gather the capacitive sensor ear images at least partly by making capacitive sensor measurements through the cushions with the cushion electrodes.

14. The headphones defined in claim 13 further comprising grill electrodes overlapped by each of the grills, wherein the control circuitry is configured to gather the capacitive sensor ear images at least partly through the grills using the grill electrodes.

15. The headphones defined in claim 14 wherein the control circuitry is configured to determine the orientation by applying a machine learning classifier to the capacitive sensor ear images.

16. The headphones defined in claim 15 further comprising a flexible printed circuit having metal traces that form at least the grill electrodes.

17. The headphones defined in claim 16 wherein the flexible printed circuit has an opening that overlaps a central portion of the grill.

18. The headphones defined in claim 17 wherein the metal traces further form at least some of the ring electrodes.

19. A wearable device, comprising:

a first ear cup having a first speaker overlapped by a first speaker grill and having a first ring-shaped cushion that surrounds the first speaker grill;

a second ear cup having a second speaker overlapped by a second speaker grill and having a second ring-shaped cushion that surrounds the second speaker grill;

a support structure that couples the first and second ear cups; and capacitive sensor circuitry configured to capture capacitive sensor ear images at least partly by making capacitive sensor measurements through the first and second ring-shaped cushions using cushion electrodes that are overlapped by the first and second ring-shaped cushions.

20. The wearable device defined in claim 19 further comprising:

first and second flexible printed circuits having metal traces that form ring electrodes, wherein the first flexible printed circuit wraps at least partly around the first speaker grill and is surrounded by the first ring-shaped cushion and wherein the second flexible printed circuit wraps at least partly around the second speaker grill and is surrounded by the second ring-shaped cushion.

* * * * *